US011192148B2

(12) United States Patent
Nolte et al.

(10) Patent No.: US 11,192,148 B2
(45) Date of Patent: Dec. 7, 2021

(54) CONDUCTOR CLEANING APPARATUS

(71) Applicant: Utility Solutions, Inc., Hickory, NC (US)

(72) Inventors: Matthew Nolte, Hickory, NC (US); Eugene H. Wood, Hickory, NC (US); Daniel Shirilla, Hickory, NC (US); Peter Shirilla, Hickory, NC (US); Aaron Wood, Hickory, NC (US)

(73) Assignee: UTILITY SOLUTIONS, INC., Hickory, NC (US)

( * ) Notice: Subject to any disclaimer, the term of this patent is extended or adjusted under 35 U.S.C. 154(b) by 0 days.

(21) Appl. No.: 17/038,005

(22) Filed: Sep. 30, 2020

(65) Prior Publication Data

US 2021/0094076 A1 Apr. 1, 2021

Related U.S. Application Data

(60) Provisional application No. 62/908,034, filed on Sep. 30, 2019.

(51) Int. Cl.
*B08B 1/00* (2006.01)
*A46B 9/06* (2006.01)

(52) U.S. Cl.
CPC ..... *B08B 1/002* (2013.01); *A46B 9/06* (2013.01)

(58) Field of Classification Search
CPC ..... A46B 9/06; A46B 5/0008; A46B 5/0012; A46B 5/002; A46B 5/0041; A46B 2200/3093; B08B 1/002
See application file for complete search history.

(56) References Cited

U.S. PATENT DOCUMENTS

| | | | | | |
|---|---|---|---|---|---|
| 2,723,412 | A * | 11/1955 | Harris | A47L 4/02 | 15/220.3 |
| 5,295,278 | A * | 3/1994 | Condon | A46B 5/0012 | 15/104.04 |
| 5,319,823 | A * | 6/1994 | Baum | A46B 3/18 | 15/143.1 |
| 8,839,804 | B2 * | 9/2014 | Phillips | B08B 3/10 | 134/184 |
| 2009/0038090 | A1 * | 2/2009 | Beck | H02G 1/04 | 15/22.1 |
| 2018/0206622 | A1 * | 7/2018 | Wilson | A46B 5/0012 | |
| 2019/0060967 | A1 * | 2/2019 | Fairbanks | A47L 17/06 | |
| 2019/0199071 | A1 * | 6/2019 | Shachar | B08B 1/00 | |

* cited by examiner

*Primary Examiner* — Weilun Lo
(74) *Attorney, Agent, or Firm* — Trego, Hines & Ladenheim, PLLC; Brandon Trego; Jonathan Hines

(57) ABSTRACT

A conductor cleaning apparatus is disclosed. The conductor cleaning apparatus includes a handle; a first arm pivotally connected to a second arm, the second arm being connected to the handle; and a first wire pad connected to the first arm and a second wire pad connected to the second arm, the first and second wire pads being configured to engage and clean a conductor positioned between the first and second wire pads.

15 Claims, 4 Drawing Sheets

CONDUCTOR CLEANING APPARATUS

BACKGROUND OF THE INVENTION

This invention relates generally to a conductor cleaning apparatus, and more particularly to a conductor cleaning brush for electrical conductors including those used by utilities to transmit electrical power to consumers.

Electrical conductors are subject to corrosion, dirt, and other environmental effects that can inhibit performance of electrical transmission through conductors. One of the areas where such inhibition occurs is at connection points. For example, compression connectors require proper cleaning of the conductor to provide a proper connection. If improperly cleaned, failures can occur. As a result, lineman often times climb up to the connection point and use a standard wire brush to clean the area of the conductor where the connection is to be made. Unfortunately, such a method can result in poor cleaning and safety hazards to the lineman.

Accordingly, there is a need for a conductor cleaning brush that provides proper cleaning without creating a safety hazard for the lineman.

BRIEF SUMMARY OF THE INVENTION

This need is addressed by the present invention, which provides a conductor cleaning brush that can be attached to a hot stick (insulated pole) and that adapts to the shape of the conductor.

According to an aspect of the invention, a conductor cleaning apparatus includes a handle; a first arm pivotally connected to a second arm, the second arm being connected to the handle; and a first wire pad connected to the first arm and a second wire pad connected to the second arm, the first and second wire pads being configured to engage and clean a conductor positioned between the first and second wire pads.

According to another aspect of the invention, a conductor cleaning apparatus includes a handle; a first arm having a first end, a second end opposite the first end, and a middle section positioned therebetween; a second arm having a first end, a second end opposite the first end, and a middle section positioned therebetween, the second arm being connected to the handle, wherein the first end of the first arm is pivotally connected to the first end of the second arm; and a first wire pad connected to the first arm at the middle section of the first arm and a second wire pad connected to the second arm at the middle section of the second arm such that a conductor may be positioned between the first and second wire pads for cleaning.

According to another aspect of the invention, a method of cleaning includes positioning a conductor between a second end of the first arm and a second end of the second arm; pushing the apparatus against the conductor such that the first and second arms move from a non-use position to a use position to allow the conductor to be positioned between the first and second wire pads; and rotating the apparatus around the conductor such that the first and second wire pads clean the conductor.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
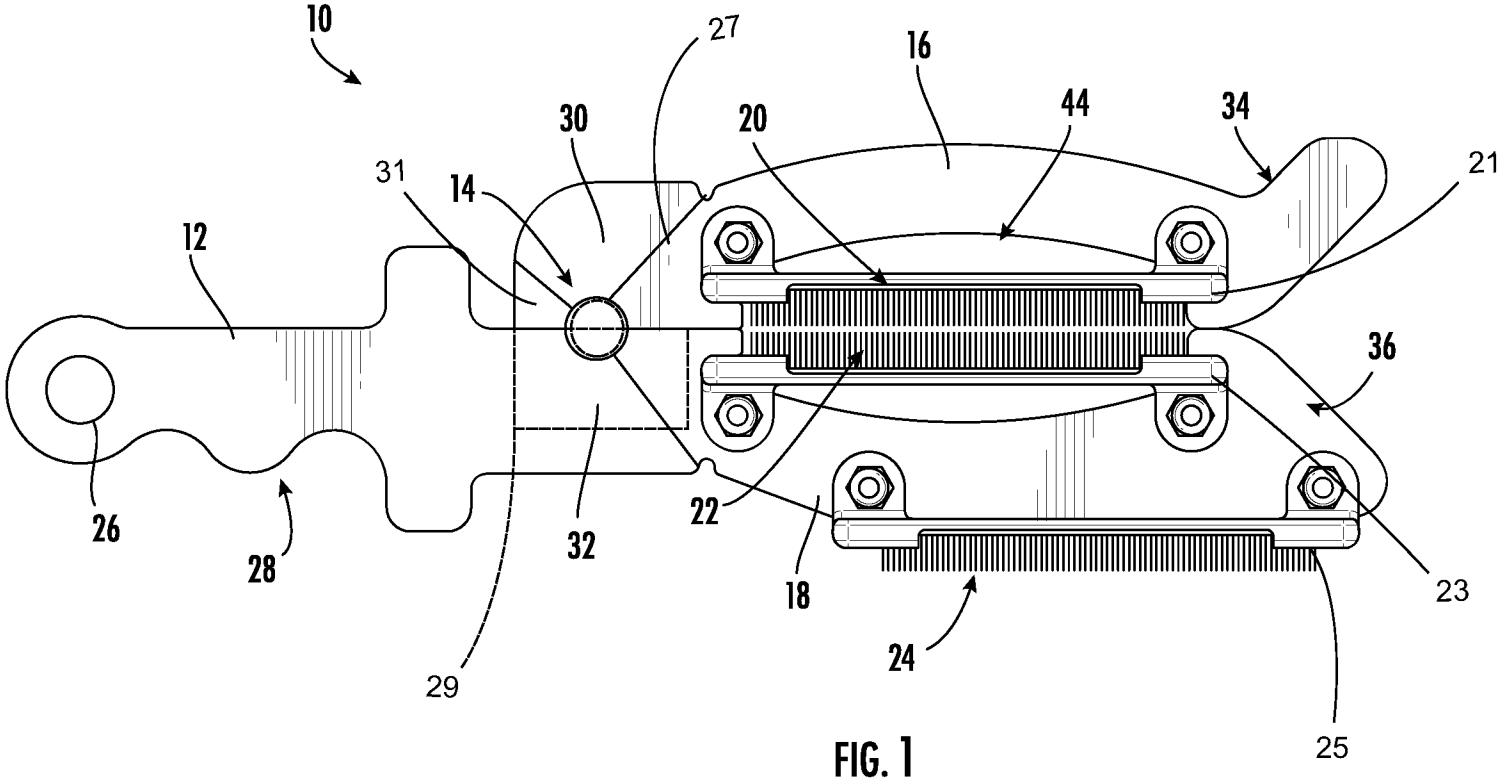
FIG. 1 shows a conductor cleaning brush according to an embodiment of the invention.

Referring to the drawings wherein identical reference numerals denote the same elements throughout the various views, FIG. 1 illustrates an exemplary conductor cleaning apparatus 10 constructed according to an aspect of the present invention. As shown, the conductor cleaning apparatus 10 includes a handle 12, a pivot joint 14 interconnecting first and second arms 16 and 18 respectively, a first flexible wire pad 20 positioned in a first pad holder 21 connected to the first arm 16, a second flexible wire pad 22 positioned in a second pad holder 23 connected to the second arm 18, and a third wire pad 24 positioned in a third pad holder 25 connected to a bottom of the second arm 18. The wire pads 20, 22, and 24 may be removed from the pad holders without tools.

The handle 12 is configured to be used by hand or by attaching it to a hot stick or insulated stick. As shown, the handle 12 includes an aperture 26 for connection to a hot stick and finger grooves 28 for allowing a user to grip the conductor cleaning apparatus 10. The aperture 26 allows a hook type end on a hot stick to be used to allow the conductor cleaning apparatus 10 to move up to 180 degrees about a conductor for easy cleaning.

Figure 2:
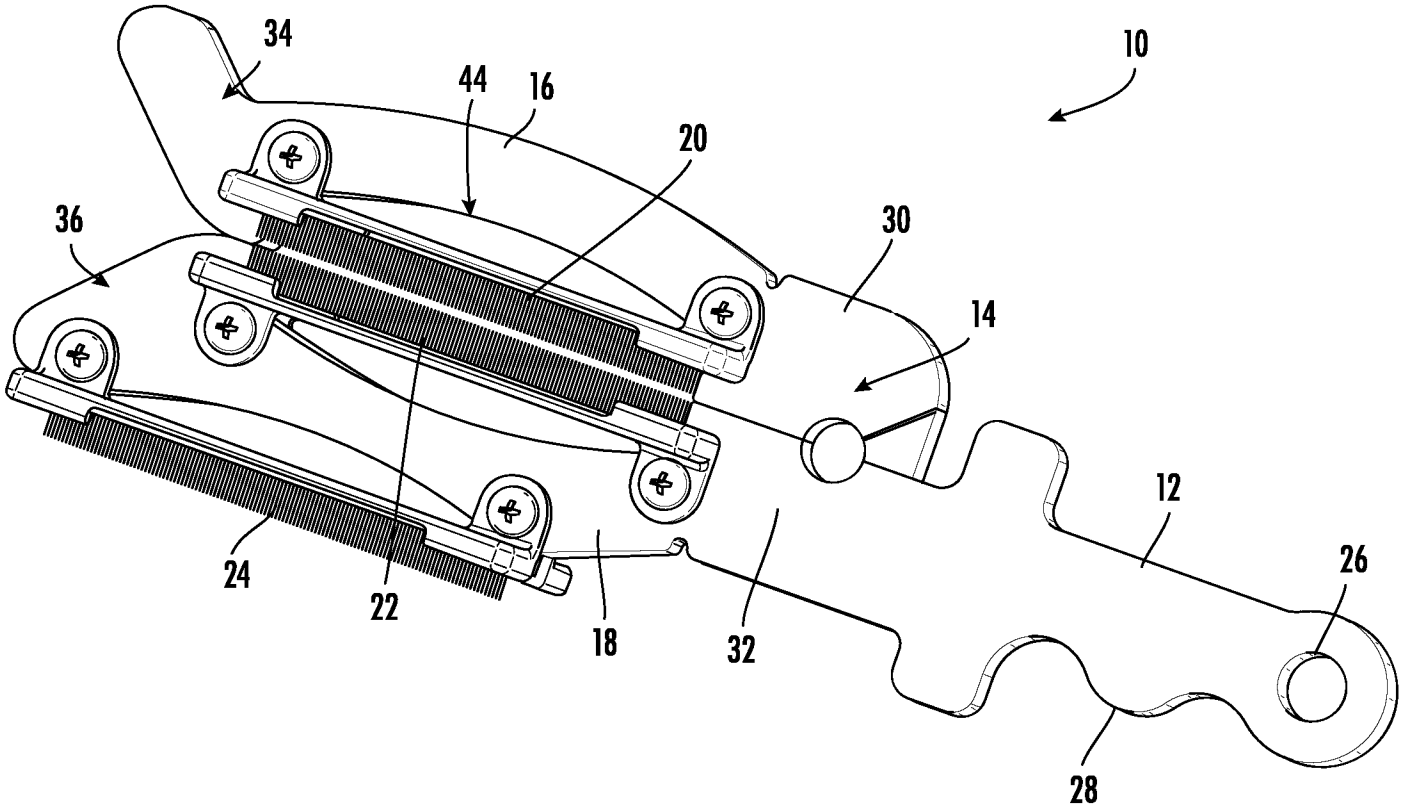
FIG. 2 is a perspective view of the conductor cleaning brush of FIG. 1.
Figure 3:
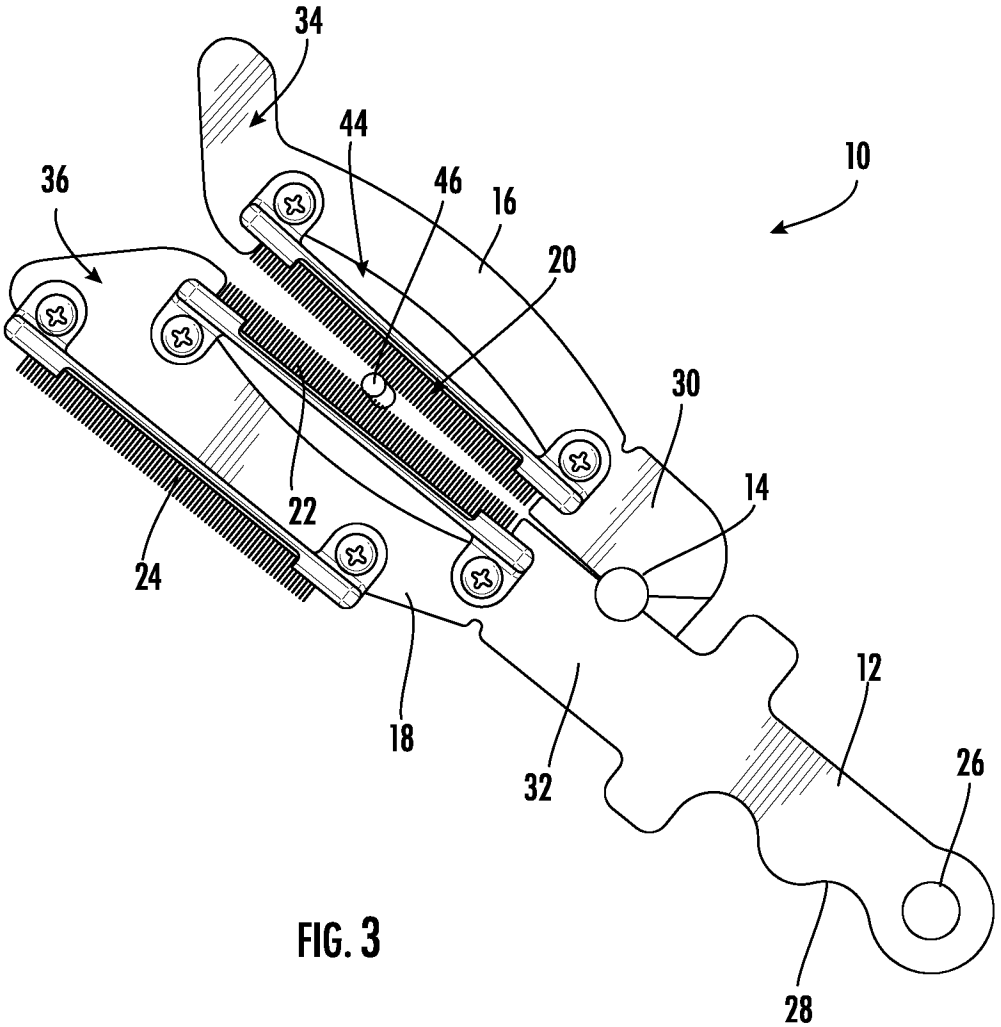
FIG. 3 shows the conductor cleaning brush of FIG. 1 with a small conductor placed between flexible brush pads.
Figure 4:
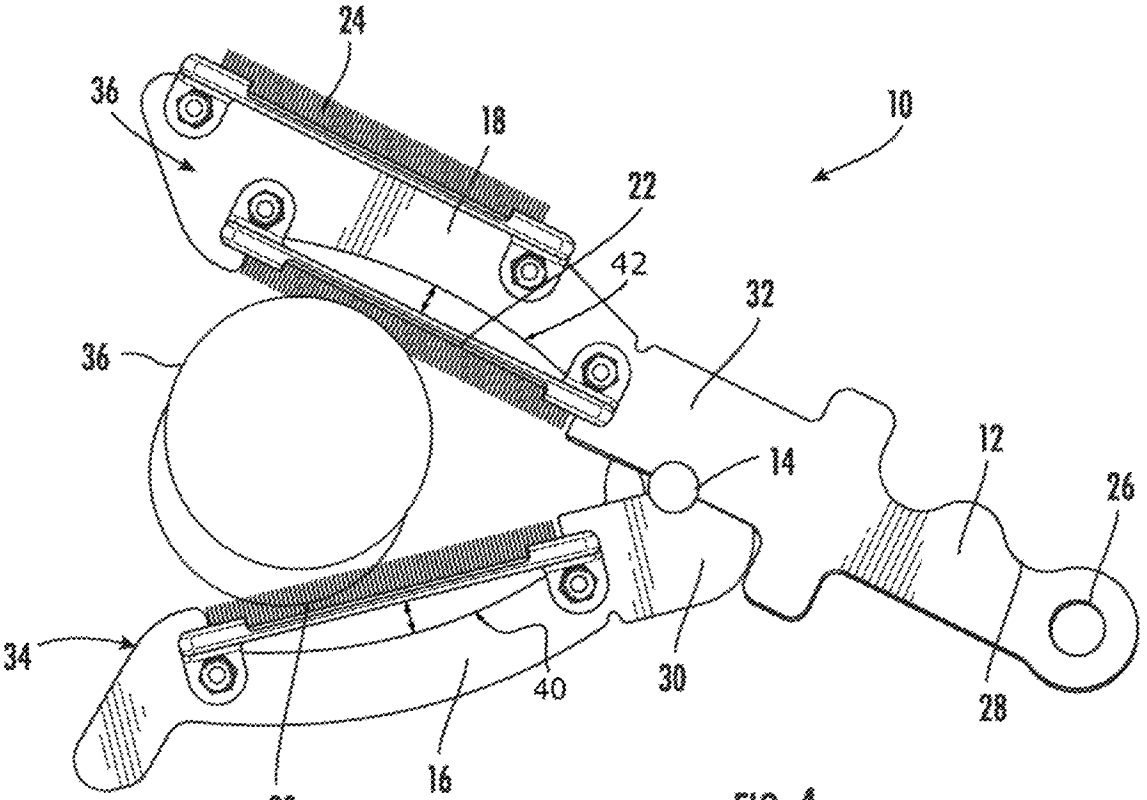
FIG. 4 shows the conductor cleaning brush of FIG. 1 with a large conductor placed between flexible brush pads.

The first and second arms 16, 18 are connected together at their first ends 30, 32 by pivot joint 14 to allow the arms to move from a closed position, FIGS. 1 and 2, to an open position, FIGS. 3 and 4. As illustrated, the second arm extends outwardly from the handle 12 and may be integrally formed therewith or connected thereto.

The pivot joint 14 includes a spring 27 or other suitable tension mechanism to maintain the first and second arms 16 and 18 in the closed position when not in use and to bias the first and second arms 16 and 18 towards the closed position when in the open position to maintain the first and second flexible wire pads 20, 22 in contact with a conductor. The pivot joint 14 includes a pocket 29 formed in the second arm 18 and a thinner section 31 (smaller width than rest of first arm 16) formed on the first end 30 of the first arm 16 which slides in and out of the pocket 19 when pivoting the first and second arms 16 and 18 between the open and closed positions. As shown, at second ends 34, 36 of the first and second arms 16, 18, respectively, the first and second arms 16 and 18 abut each other in the closed position and separate from each other in the open position.

Each of the first and second arms 16, 18 have an arched middle section 40, 42 to create an opening 44 therebetween. As illustrated, the second ends 34, 36 flare outwardly from a centerline of the apparatus 10 to receive a conductor therebetween. When a user pushes the apparatus 10 against a conductor 46 positioned in a space between the flared second ends 34, 36, the second ends 34 and 36 move outwardly to allow the conductor 46 to be received in the opening 44 between the first and second flexible wire pads 20, 22.

The first flexible wire pad 20 is positioned in the opening 44 and connected to the first arm 16 and the second flexible wire pad 22 is positioned opposite the first flexible wire pad 20 in the opening 44 and connected to the second arm 18.

The first and second flexible wire pads 20 and 22 flex between a non-use position, FIG. 1 where the first and second flexible wire pads 20 and 22 are substantially flat and parallel with each other, and a use position, FIG. 3, where the conductor 46 lies between the first and second flexible wire pads 20, 22. In the use position, the first and second wire pads 20, 22 flex, as indicated by double arrows, to conform to the shape of the conductor 46; thus enveloping the conductor 46 so that the conductor is cleaned around its entire periphery. When enveloping the conductor, the pad holders 21, 23 and respective flexible wire pads 20 and 22 flex outwardly towards the first and second arms 16 and 18 to conform to the shape of the conductor. As shown in FIGS. 3 and 4, the apparatus 10 is capable of being used with conductors of various sizes, for example, a 0.3175 cm (0.125 in) conductor to a 27.94 cm (11 in) conductor. It should be appreciated that the apparatus 10 may be used with other ranges of conductor size.

The third wire pad 24 is connected to a bottom of the second arm 18 and allows a user to clean both planar surfaces as well as other odd shaped surfaces that do not require three-hundred-and-sixty-degree cleaning.

The foregoing has described a conductor cleaning apparatus. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

We claim:

1. A conductor cleaning apparatus, comprising:

a handle;

a first arm pivotally connected to a second arm at a pivot joint, the second arm being connected to the handle, wherein the first and second arms each include an arched middle section; and a first flexible wire pad connected to the first arm and a second flexible wire pad connected to the second arm, the first flexible wire pad being positioned in the arched middle section of the first arm and the second flexible wire pad being positioned in the arched middle section of the second arm, wherein the first and second flexible wire pads being configured to engage and clean a conductor positioned between the first and second flexible wire pads.

2. The conductor cleaning apparatus of claim 1, wherein the pivot joint includes a pocket formed in the second arm, a portion of the first arm positioned in the pocket for rotation therein, and a spring to bias the first and second arms in a closed position.

3. The conductor cleaning apparatus of claim 2, wherein the pivot joint is positioned at first ends of the first and second arms.

4. The conductor cleaning apparatus of claim 1, wherein the first and second flexible wire pads are spaced from the arched middle sections.

5. The conductor cleaning apparatus of claim 3, wherein the first and second arms each include a second end opposite the first ends, the second end of the first arm is flared outwardly from a centerline of the apparatus and the second end of the second arm is flared outwardly from the centerline of the apparatus.

6. A conductor cleaning apparatus, comprising:

a handle;

a first arm having a first end, a second end opposite the first end, and an arched middle section positioned therebetween;

a second arm having a first end, a second end opposite the first end, and an arched middle section positioned therebetween, the second arm being connected to the handle, wherein the first end of the first arm is pivotally connected to the first end of the second arm; and a first flexible wire pad connected to the first arm at the arched middle section of the first arm and a second flexible wire pad connected to the second arm at the arched middle section of the second arm such that a conductor may be positioned between the first and second flexible wire pads for cleaning.

7. The conductor cleaning apparatus of claim 6, wherein the first and second flexible wire pads are positioned in an opening created between the first and second arms.

8. The conductor cleaning apparatus of claim 6, further including a third wire pad connected to the second arm, the third wire pad being positioned on a bottom of the second arm.

9. The conductor cleaning apparatus of claim 6, wherein each of the arched middle sections of the first and second arms is arched outwardly from a centerline of the apparatus to permit the first and second flexible wire pads to flex between a non-use position and a use position.

10. The conductor cleaning apparatus of claim 6, wherein the second ends of the first and second arms are flared outwardly from a centerline of the apparatus.

11. The conductor cleaning apparatus of claim 6, further including a spring at the first ends of the first and second arms to bias the first and second arms towards a closed position.

12. A method of cleaning a conductor, comprising:

providing a conductor cleaning apparatus comprising:

a handle;

a first arm pivotally connected to a second arm at a pivot joint, the second arm being connected to the handle, wherein the first and second arms each include an arched middle section; and a first flexible wire pad connected to the first arm and a second flexible wire pad connected to the second arm, the first flexible wire pad being positioned in the arched middle section of the first arm and the second flexible wire pad being positioned in the arched middle section of the second arm, wherein the first and second flexible wire pads being configured to engage and clean a conductor positioned between the first and second flexible wire pads;

positioning a conductor between a second end of the first arm and a second end of the second arm;

pushing the apparatus against the conductor such that the first and second arms move from a non-use position to a use position to allow the conductor to be positioned between the first and second flexible wire pads; and rotating the apparatus around the conductor such that the first and second flexible wire pads clean the conductor.

13. The method of claim 12, further including the step of pulling the apparatus away from the conductor to remove the conductor from between the first and second flexible wire pads when the conductor is clean and allowing the first and second arms to move from the use position to the non-use position.

14. The method of claim 12, wherein the step of pushing the apparatus against the conductor first and second ends includes contacting the conductor with portions of the first and second arms that are flared outwardly from a centerline of the apparatus to receive the conductor therebetween.

15. The method of claim 13, wherein the step of allowing the first and second arms to move from the use position to the non-use position includes using a spring to bias the first and second arms towards the non-use position.

* * * * *